US007000373B2

(12) United States Patent
Badiali et al.

(10) Patent No.: US 7,000,373 B2
(45) Date of Patent: Feb. 21, 2006

(54) INTRODUCING/REMOVING DEVICE OF THE END IN AN OPEN-END SPINNING ROTOR

(75) Inventors: Roberto Badiali, Pordenone (IT); Vittorio Colussi, Cappella Maggiore (IT); Donato Castellarin, Azzano Decimo (IT)

(73) Assignee: Savio Macchine Tessili S.p.A., Pordenone (IT)

( * ) Notice: Subject to any disclaimer, the term of this patent is extended or adjusted under 35 U.S.C. 154(b) by 0 days.

(21) Appl. No.: 10/963,684

(22) Filed: Oct. 13, 2004

(65) Prior Publication Data

US 2005/0081505 A1 Apr. 21, 2005

(30) Foreign Application Priority Data

Oct. 16, 2003 (IT) ..... MI2003A2004

(51) Int. Cl.
*D01H 15/00* (2006.01)

(52) U.S. Cl. ..... 57/22; 57/263

(58) Field of Classification Search ..... 57/22, 57/23, 263, 279, 301; 242/473.6, 475.2
See application file for complete search history.

(56) References Cited

U.S. PATENT DOCUMENTS 4,653,260 A * 3/1987 Artzt et al. ..... 57/263
2005/0016156 A1 * 1/2005 Brandi et al. ..... 57/279

* cited by examiner

*Primary Examiner*—John J. Calvert
*Assistant Examiner*—Shaun R. Hurley
(74) *Attorney, Agent, or Firm*—Hedman & Costigan, P.C.

(57) ABSTRACT

Introducing/removing device of the end of the thread for an automatic service trolley for spinning units of open-end spinning machines comprising a moving structure, capable of taking a gripping member into various working positions and equipped with a gripping member consisting of a pair of parallel motorised rollers pressed against each other according to their generatrices, equipped with actuation in commanded and controlled rotation in the two directions, to introduce and re-extract the end of the thread in the rotor.

9 Claims, 5 Drawing Sheets

C
42
43
54
50
45
30
44
46
48
70
56
57
58
59
60
62
41

INTRODUCING/REMOVING DEVICE OF THE END IN AN OPEN-END SPINNING ROTOR

The present invention refers to open end spinning, or rotor spinning. Open-end spinning machines generally consist of a plurality of individual spinning units, aligned on the two sides of the machine, each of which is made up of a spinning rotor, which produces twisted tread from singularised fibres of a rove, and a collection unit that—with the prior quality control of yarn with the interposition of a yarn clearer between the two components—carries the yarn to wind onto a quill to form a cone. This cone is thus formed pulling and winding the yarn on its surface, being pulled into rotation by the roller below on which the cone in formation is rested. The yarn is wound in a spiral on the cone in rotation since the collection unit is equipped with a thread-guiding device that distributes the yarn on the outer surface of the cone with to and fro axial motion.

Figure 1:
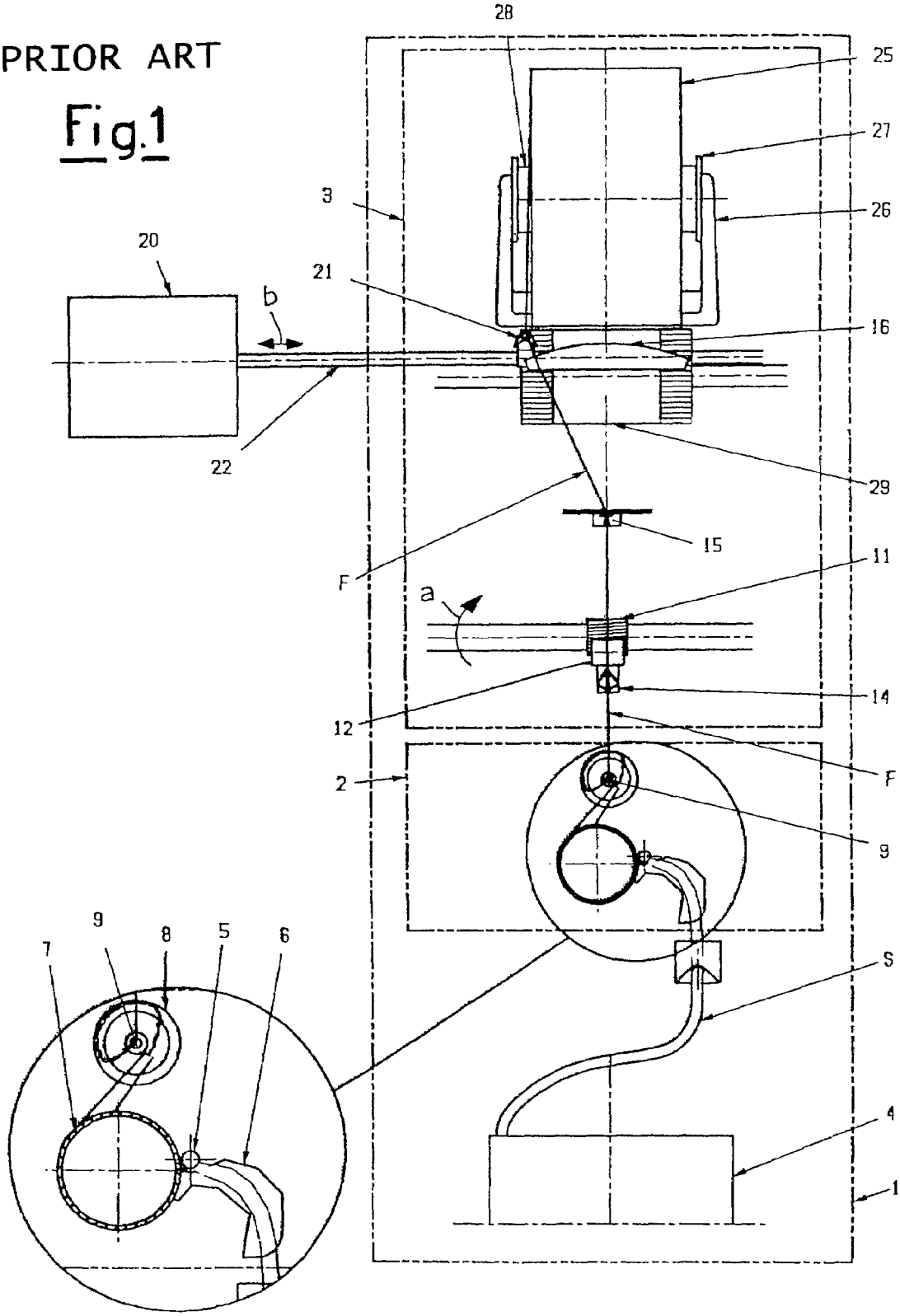
PRIOR ART Fig.1

The structure of the individual spinning station is illustrated in the scheme of FIG. 1, and its operation according to its normal running is briefly described hereafter.

Proceeding from the bottom towards the top, the spinning unit 1 consists of the spinning unit 2 and the collection unit 3, the main components of which that lead to the transformation of the rove of fibres made to run parallel in the cone of wound yarn are briefly illustrated hereafter.

The supply band or rove S is contained in a cylindrical vessel 4 where it is deposited in a double spiral. The rove S is supplied to the unit by a supply roller 5 passing through the funnel-shaped conveyor 6 and reaches the card 7, a rotating roller equipped with a toothed trimming that singularises the fibres of the rove S and conveys them by suction to the spinning rotor 8, which works in a vacuum.

In the spinning rotor 8, which rotates at very high speeds (up to 150,000 revs/minute and beyond), the singularised fibres are deposited in its peripheral throat by centrifugal effect; from here they are collected and picked up in the form of thread F, coming out axially from its central opening 9, receiving the twists from the rotation of the rotor itself in the path that runs between its inner throat and such an opening 9, thus generating the twisted thread F.

The pulling back of the thread is carried out with a pair of opposite extraction cylinders 11 and 12 for gripping the thread F and actuated at a controlled speed according to the arrow a, thus determining the linear production of yarn, generally indicated in m/min. The yarn clearer 14 for controlling the quality of the yarn F can be placed before the cylinders 11/12. The thread F thus produced enters into the collection unit 3, passes by a sensor 15 of the presence of thread and meets a compensator 16 for compensating the variations in length of the path between the spinning unit 2 and the deposit point of the yarn F on the cone. The thread-guiding device 21 distributes the thread on the cone in formation moving transversally with to and fro motion according to the double arrow b, actuated by a motor 20 that commands a longitudinal shaft 22 in common with the other units of the spinning machine.

The cone 25 collects the thread F and is held by the cone-holding arm 26 equipped with two idle tailstocks 27 that can be opened that go into engagement with the basic quill 28 of the cone. The cone in formation 25 is rested upon its actuation roller or collection cylinder 29.

Recently conceived automatic open-end spinning machines are equipped with service trolleys that patrol the sides of the spinning machine and carry out the required interventions stopping in front of the spinning unit that requires it.

The required interventions are essentially of three types:

- for starting, at the beginning of the spinning from a still spinning machine, starting it and then placing a new quill in each station, carrying out the start-up with an auxiliary thread and winding the thread produced on the new quill to give a cone, after having eliminated that portion of auxiliary thread;
- for reattachment, when the yarn is interrupted for whatever reason, without having yet reached the length foreseen for completing the cone, using the yarn already produced by the side of the cone, carrying out the actual reattachment and continuing the winding on the same cone. The overall procedure of the reattachment cycle essentially consists of the opening, cleaning and closing of the rotor, the preparation of the tail of the rove, the capturing and preparation of the end at the side of the cone, the restarting of the rotor and the continuation of the supply, the introduction of the prepared end into the rotor, the re-extraction of the end connected to the newly produced thread winding it once again in the collection unit. The programmed cleaning cycle is the equivalent to the reattachment cycle, caused with a commanded breaking of the thread;
- for lifting, after having reached the foreseen length for the cone to be complete. The finished cone is discharged and then one proceeds to starting the unit as outlined above.

Generally, such interventions are carried out by separating the cone 25 from its actuation cylinder 29, stopping its motion and actuating the cone 25 or its quill 28 by an auxiliary actuation roller arranged on-board the service trolley.

In the field of devices and procedures for the intervention of service trolleys on automated open end spinning machines the applicant is the owner, amongst others, of patents IT 1.146.694, EP 340.863, EP 443.220, EP 473.212, IT 1.258.220, IT 1.258.221, IT 1.258.222.

In general, the automation trolley consists of a structure mobile along the sides of the machine, a communication system with the central control unit of the spinning machine and with the spinning unit that make up the machine, a translation and stopping system of the trolley in front of the units that require intervention. The mobile structure carries on-board members or groups of members dedicated to the single or multiple operations of the various cycles, which can at various times be required.

With the evolution of open-end spinning machine technology, the range of counts, of yarns and of fibres to be worked has substantially widened, whereas the quality specifications of yarn have become more stringent. With the overall cycles relative to reattachment and lifting in which a substantial number of members or groups of members on-board the trolley cooperate, its efficiency, in other words the successful completion of the operation without carrying out many attempts over and again, is very important. The coordination of said members is therefore very important for controlling them as regards relative positions, time and speed phasing of such members both in relation to each other and with respect to the thread that is adopted, manipulated and exchanged by said members, controlling the successful completion of each step of the process.

In each of the intervention cycles described above on the open-end spinning units it is foreseen to carry out the actual reattachment operation of the thread, in other words, the catching of the singularised fibres in the throat of the rotor 8 introducing a prepared end of thread into the opening 9 and withdrawing it after the fibres present in the throat have twisted together with the end through the effect of the rotation of the rotor and have restored the continuity of the thread.

The reattachment procedure has a direct influence upon the quality of the yarn, both as far as its mechanical characteristics and its aesthetic characteristics are concerned. The join of the thread is practically undetectable, substantially maintaining the same size and the same twists per meter as the yarn produced normally, having the same resistance to tension. Therefore, larger joins should be avoided, for aesthetic reasons, and smaller joins or with a number of twists per meter that is different from normal yarn should be avoided, also for mechanical resistance reasons. If the irregularity of the joined thread exceeds the calibration of the yarn clearer 15, it is the yarn clearer itself that interrupts the thread causing the elimination of the defective portion and the repetition of the entire reattachment cycle.

To obtain the required quality of the join, in the introduction and re-extraction step of the end, both the times and the relative speeds with which one operates are very important. Such parameters, in the relationships between the various members that work together, must respect precise synchronisms, also to the hundredth of a second, and exact speed ratios. There is also the further complication that such relationships must be maintained during transitory steps both in the spinning unit and in the collection unit.

The end must advance by a precise distance and manage to catch the fibres in the throat of the rotor 8 at the moment when the desired amount of fibres has accumulated in it from the start of the supply of the rove S with the roller 5. The end must remain in the throat of the rotor for a brief but predetermined time and then be pulled back at a speed such as to allow the newly formed thread to receive the desired number of twists per meter.

In the prior art, the catching operation of the fibres with the end of the thread is generally carried out by dividing the functions of introduction and of re-extraction of the end between different members.

For the introduction function in some open-end spinning machines the suction exerted by the rotation of the rotor 8 in the opening 9 is exploited: a significant vacuum is generated inside it by aerodynamic effect and a substantial suction action from the opening 9 is determined. The introducing member is basically limited to a member that has the end at the opening 9 and releases it to its suction action.

This way of operating is not without drawbacks since the rotor 8 is an a transitory step and exerts variable suction, because there is not effective control of the length of the end that arrives in the throat of the rotor and also because the thread is not controlled well upstream of the end, which must be kept taut to avoid it from becoming entangled in the parts of the machine when it is released/withdrawn.

In the prior art the re-extraction of the re-attached end is generally carried out by another member: for example, a pair of motorized auxiliary rollers capable of withdrawing the end of the thread according to a controlled acceleration ramp coherent with that of the rotor, until the working speed is reached. The further extraction of the thread, once at operating speed, is then carried out by the extraction cylinders 11/12.

Also here there are problems of synchronism of the operation divided between the two different members with different actuations.

The present invention is relative to a device for introducing and re-extracting the end for carrying out the actual reattachment to restore the continuity of the thread during the operating cycles of the trolley to service the open-end spinning machine.

The purpose of the present invention is that of making a single device for introducing and re-extracting the end during the intervention cycles of the trolley, which overcomes the drawbacks of devices available in the state of the art and allows greater efficiency of the trolley and greater yield of the spinning machine to be obtained, increasing the percentage of successful reattachment cycles for the quality of the join and reducing the idle time due to the repetition thereof.

To better highlight the problems tackled and the technical solutions proposed with the present invention we thus refer, in the following description, to a scheme of a trolley in which the device according to the invention is inserted, for servicing an open-end spinning machine, as a non-limiting example, with the explicit warning that it can advantageously also be used in a trolley in which the groups and the service members are different in type and arrangement.

The device according to the invention is defined, in its essential components, in the first claim whereas its variants and preferred embodiments are specified and defined in the dependent claims.

To illustrate the characteristics and advantages of the present invention more clearly, it is described with reference to some typical embodiments thereof shown in FIGS. 2 to 5 as an example and not for limiting purposes.

Said figures refer to an embodiment of the introducing/removing device of the thread in a rotor according to the invention.

Figure 2:
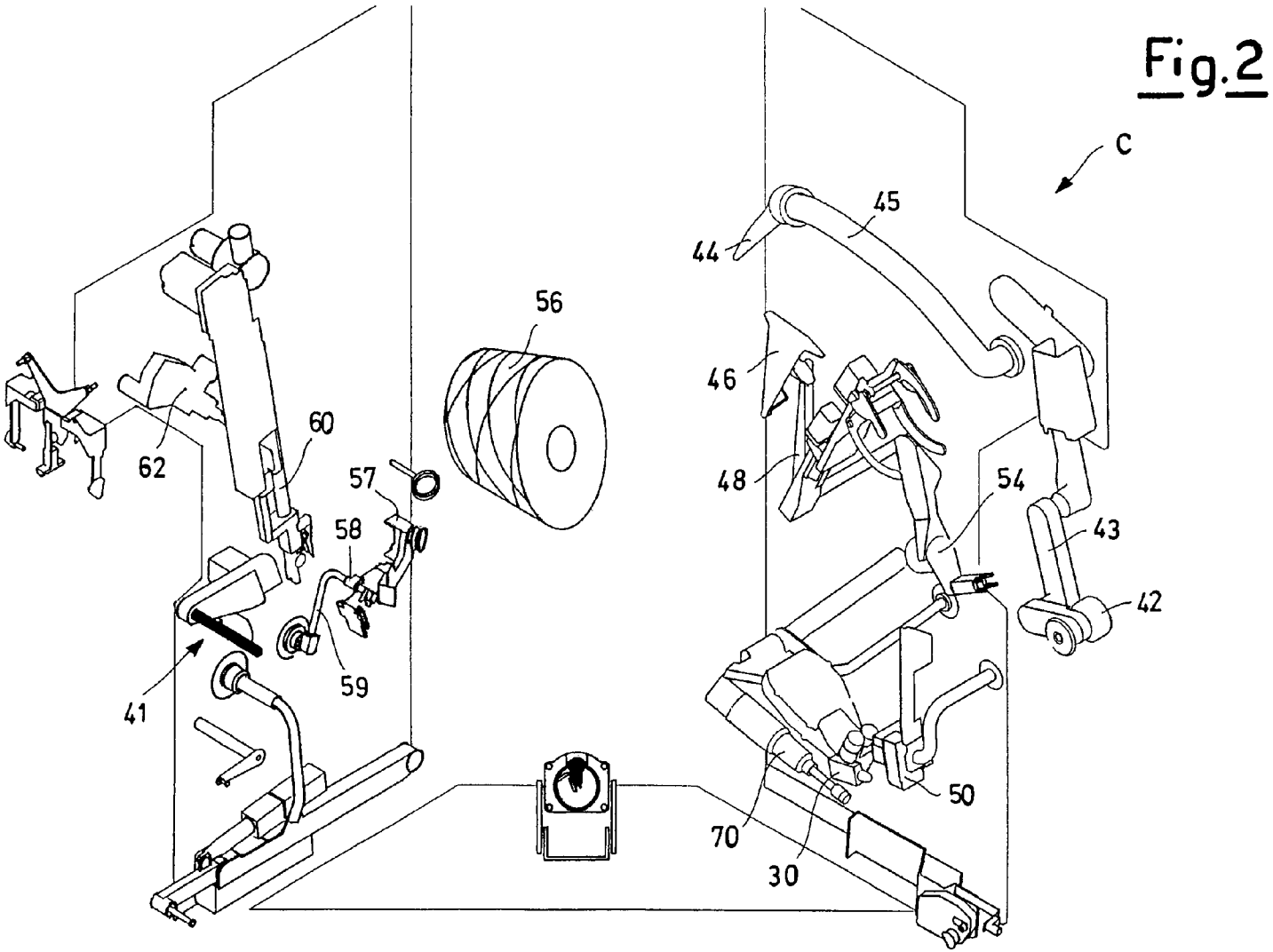

FIG. 1 illustrates the scheme of an open-end spinning station in its most significant components, in a typical embodiment thereof according to a front view and that must be serviced by the trolley FIG. 2 illustrates a scheme of a service trolley C for an open-end spinning machine, in which the most significant members or groups that intervene in servicing as well as the device according to the invention for introducing/removing the thread in the rotor are indicated.

Figure 3:
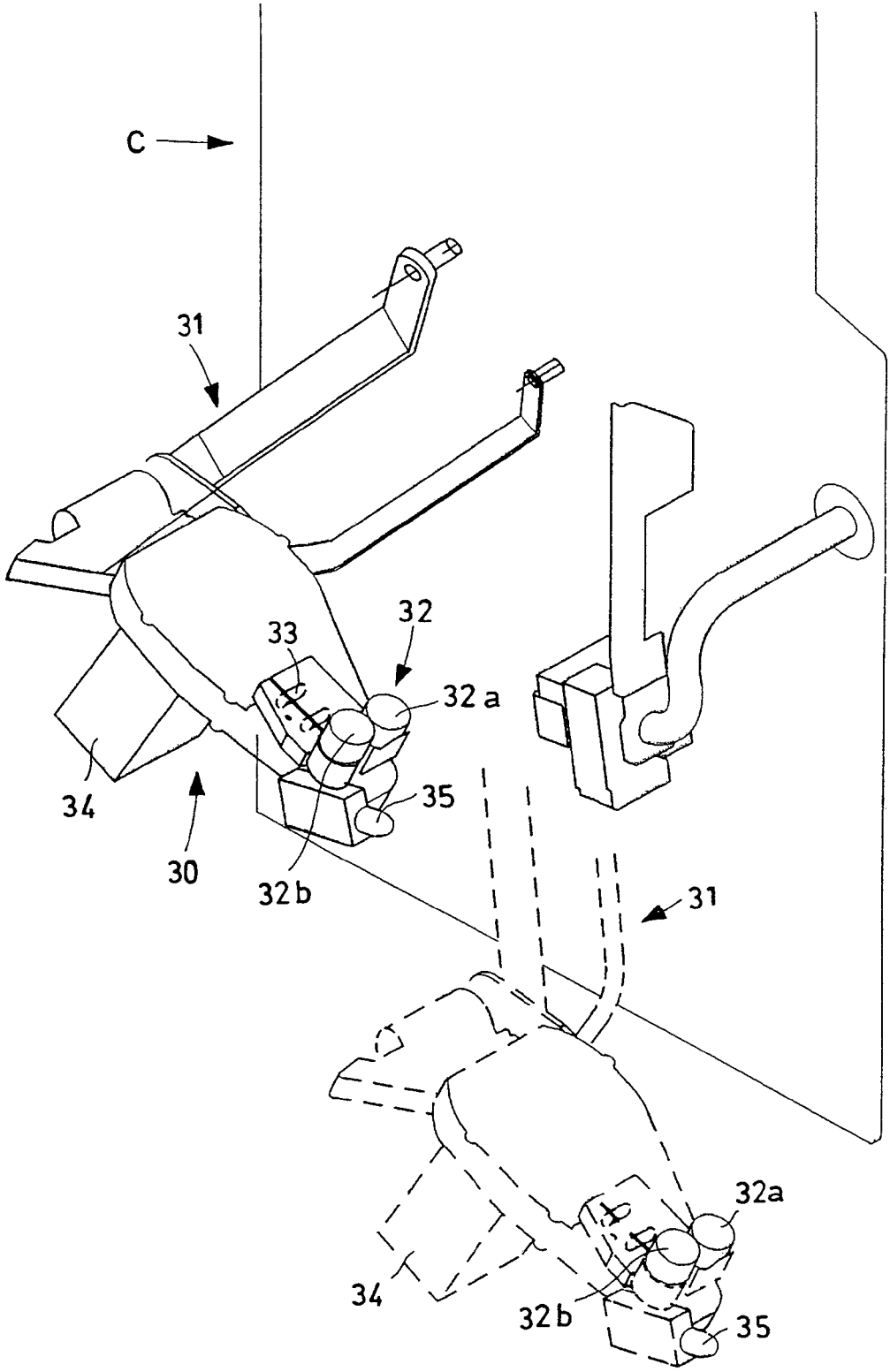

FIG. 3 illustrates the structure of the device according to the invention and its gripping, moving, introducing and removal operation of the thread to and from the rotor.

Figure 4:
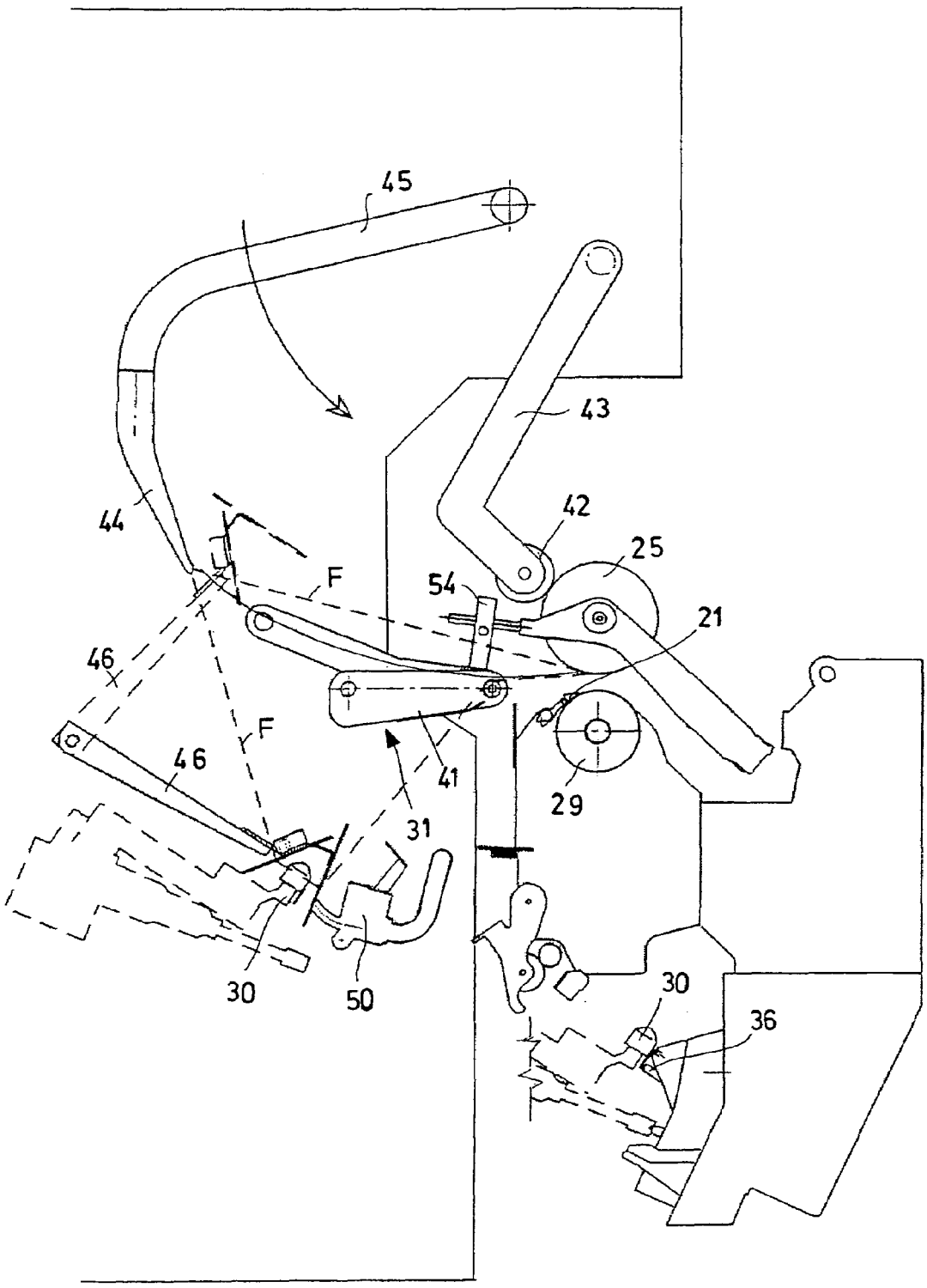
Figure 5:
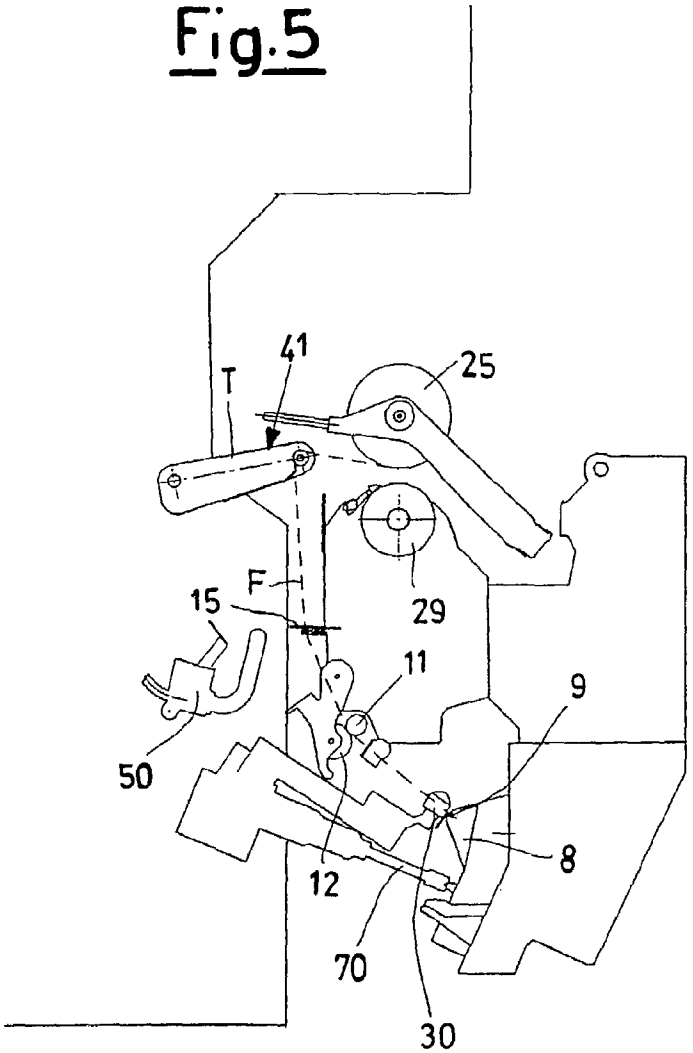
Figure 4B:
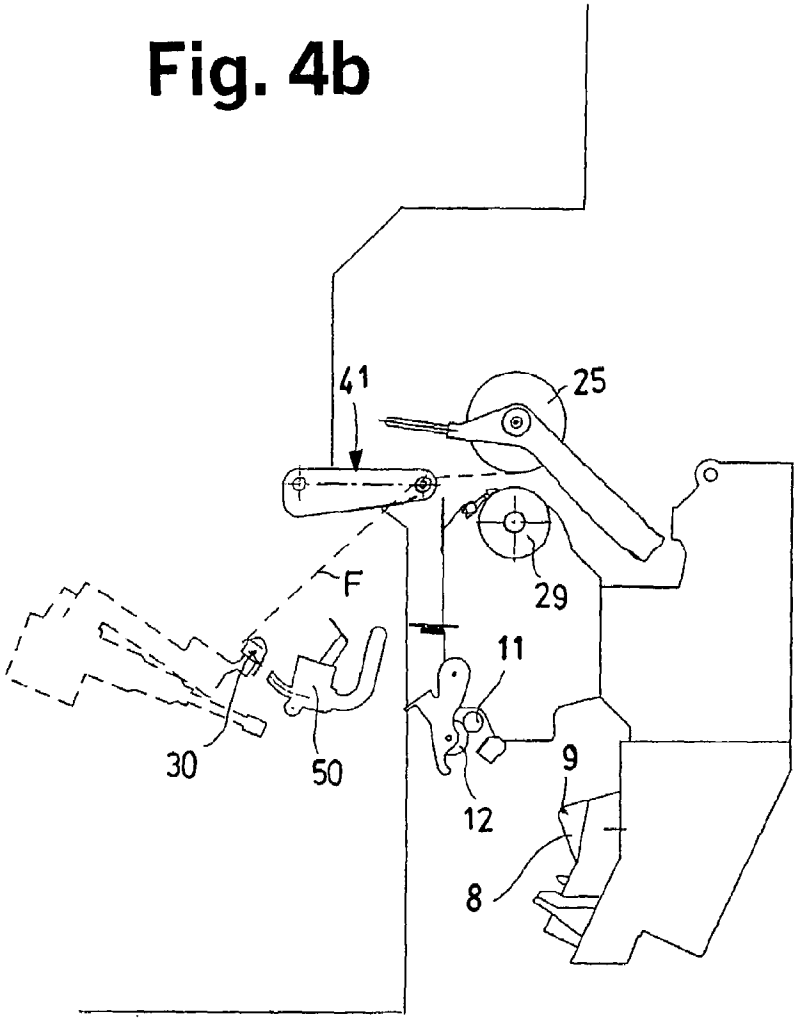

FIGS. 4, 4*b* and 5 illustrate some of the configurations and functions that the device according to the invention takes up and performs during the intervention cycles carried out by an automation trolley for open-end spinning machines.

FIG. 2 shows an exploded view of the parallelepiped space inside the trolley C, in which its most significant members or groups for servicing the open-end spinning unit, including the device 30 according to the invention for the actual reattachment of the thread:

- a device 41 for controlling and positioning the thread F during the intervention cycles that is used, during the intervention cycles, to determine the position of the thread connected with the cone or with its quill with respect to other members of the trolley;
- an auxiliary actuation roller 42 of the cone 25 or of the new quill 28, according to a clockwise/anti-clockwise rotation, during the service interventions. It can be moved forwards/backwards so as to be closer/further away with rotation of its arm 43 about a horizontal axis parallel to the front of the spinning machine. The rotation of the arm 43 is also used to discharge the finished cone pushing it towards the middle plane between the sides of the spinning machine;

a mobile suction mouth 44 for capturing the end of the thread on the side of the cone 25. It can be moved forwards/backwards so as to be closer/further away with rotation of its arm 45 about a horizontal axis parallel to the front of the spinning machine;

a centraliser device 46, consisting of an engagement and displacement fork of the thread captured by the mouth 44. It is equipped with a sensor of the presence of thread inside of it and can be raised/lowered with rotation of its arm 48 about a horizontal axis parallel to the front of the spinning machine to serve the subsequent preparing group. More details on its structure and operation are described in patent EP 473.212.

a group 50 for preparing the end of the thread, mounted in a fixed position, which receives the thread from the centraliser 46, takes it, cuts it to size and prepares it for its re-introduction into the opening 9 of the spinning rotor 8. More details on its structure and operation are described in patent EP 443.220;

the introducing/removing device 30 according to the invention, for gripping the end of the thread F prepared by the preparing group 50 and its supply to the spinning rotor 8 for restarting spinning. It is described in greater detail later on with reference to FIG. 3. The introducer/remover 30 also works in the lifting cycle operating on the auxiliary thread. In such a cycle it is the device 30 that carries the auxiliary thread to the preparer 50. It moves according to a trajectory from the preparing group 50 to the opening 9 to introduce the end of the thread to the rotor 8. The same device 30, after having introduced the end, removes it from the rotor with the reattached thread, follows the spinning acceleration ramp and, once the working speed has been reached, releases it, allowing it to be removed normally from the rotor by the pair of cylinders 11/12;

a group 54 for lifting and opening the cone-holding arm 26, which disengages the cone from its roller 29 at the start and releases it at the end of each intervention cycle. The actuation open and closed of the tailstocks 27 allows—in lifting operations—the discharge of the finished cone and the insertion of a new quill 28, gripping the thread F between its base and tailstock 27.

As well as these groups, for the lifting and starting operations the following are foreseen:

a cone 56 of auxiliary thread A that is used to start spinning, in start-up or in lifting, with the tautening transmission 57 and the pincer 58 that has the auxiliary thread A. The pincer 58 is able to intersect both the trajectory followed by the introducing/removing group 30 and that of the following gripping member 60, which can therefore take and control the auxiliary thread, take it to the preparer 50 and then go to introduce it to the spinning rotor 8 to carry out a reattachment of the auxiliary thread to the new thread in production.

For such a purpose the pincer 58 is mounted on a motorised arm 59 that rotates in the plane of the figure and carries the auxiliary thread to be gripped by said manipulation members. Downstream of the pincer 58 there are scissors that, when the auxiliary thread A has been presented and gripped by such members, cut the thread leaving its end upstream still in the pincer 58, ready for it to be subsequently taken.

a hooked gripping member 60 with suction mouth for capturing, moving and centring both the auxiliary thread and the initial new thread, to present it both to the reattachment members of the auxiliary thread during the lifting cycle and to grip the new thread between quill 28 and tailstock 27. Such a hook with mouth 60 is equipped with a V-shaped centrer and is mounted on an arm that can be extended and rotated about a horizontal axis parallel to the front of the spinning machine;

a device 62 for depositing and binding an initial reserve of thread at the end of the new quill 28. More details on its structure and operation are described in patent EP 340.863.

On the service trolley C for the open-end spinning machine a trolley control unit is also foreseen, which communicates both with the central control unit of the spinning machine, receiving instructions, and with the spinning units that make up the machine. During the course of its interventions the trolley control unit coordinates the operation of its components with that of the spinning unit serviced on each occasion.

FIG. 3 illustrates a typical embodiment of the device 30 according to the invention for introducing and removing the end of the thread to carry out the actual reattachment during the interventions of the trolley C.

The device 30 according to the invention comprises a moving structure 31, for example with a pantograph, capable of taking its gripping member 32 from an inactive (or rest) position and putting it in various working positions to take, grip, pull, release and deliver the thread from/to the various members of the trolley and of the spinning machines described up to now. In FIG. 3 the device 30 is shown in two positions: one withdrawn shown with a full line and one advanced towards the rotor 8 shown with a broken line.

The gripping member 32 consists of a pair of parallel rollers 32*a* and 32*b*, one of which is motorised and the other idle, kept pressed against each other according to their generatrices by a spring system, not indicated in the figures for the sake of simplicity. The surfaces of the two rollers are made with wear-resistant materials with good adhesion characteristics so as to ensure an effective pulling into rotation of the idle cylinder also in the steps of inversion and acceleration of the motion.

These rollers 32*a,b* are arranged with their axes substantially perpendicular to the direction of movement of the device 30 and can be moved apart from each other, overcoming the pressure of the spring system through a pneumatic cylinder 33, which is actuated to cause them to open when the thread to be gripped between them must be introduced or when the thread gripped previously must be released.

The axis of the motorised roller 32*a* has an actuation motor 34 connected to it, capable of making the roller itself rotate in commanded rotation in both directions and controlled in angular position and speed, according to the driving that is imparted by the trolley control unit, which coordinates the operation of the various parts on-board the trolley itself with that of the spinning unit during the intervention cycles. The other roller 32*b* is idle and rotates in synchrony with the roller 32*a* by pulling.

To carry out the present invention the motor 34 can be a brushless motor driven in frequency to obtain angular positions, speeds and accelerations that are controlled in every step of its operation in the two directions of rotation.

According to a preferred embodiment of the present invention the motor 34 is a stepper motor driven in steps by the trolley control unit, again to obtain angular positions and speeds that are controlled in the two directions of rotation.

When the thread F is gripped between the two rollers 32*a,b*, the introducing/removing device 30 is moved with the pantograph 31 to take the pincer 32 with its end of thread into the work stations: from/to the preparer of the end 50, to/from the rotor 8. Rotation in one direction makes the thread advance from the rollers 32*a,b* towards such members and rotation in the opposite direction makes the thread withdraw towards the rollers themselves.

To illustrate the operation and the characteristics of the device 30 for introducing and removing the thread during the interventions of the trolley more clearly, the relevant steps of the actual reattachment operation are outlined hereafter, with reference to FIGS. 4 and 5. In said FIGS. 4 and 5 the relative positions of the members of the trolley are illustrated, according to a side view both of such members and of the spinning unit that is serviced.

In general, the interruption of the thread is indicated by the sensor 15 of the presence of thread, at the entry of the collection unit 3. Following such a signal, the peripheral control unit of the spinning unit takes care of lifting the cone 25, of braking it and requests the intervention of the service trolley. The supply of the rove S to the spinning unit 2 is also stopped. The other spinning units continue to work: the members with common actuation continue their motion even with the collection unit 3 stopped.

With reference to a reattachment intervention, upon the arrival of the trolley C opposite the spinning unit to be serviced, the cycle begins:

- the idle cone 25 rises further;
- the auxiliary roller 42 is moved closer to the cone;
- the mobile suction mouth 44 for capturing the end of the thread on the side of the cone 25 is equally moved closer and then withdrawn;
- the joint action of the roller 42, to unwind the thread F from the cone 25, and of the suction with the mouth 44 picks up the thread F that unwinds with traversing motion, i.e. back and forth transversal motion;
- the centraliser device 46, indicated with a broken line in its upper position, lowers and takes the thread F in its gripping fork;
- the device 41 is lifted and keeps the thread F coming from the cone 25 detached from the trajectory of the thread guide 21, which continues its alternate motion, and stabilises it;
- when the centraliser 46 arrives in the lowest end position, indicated with a full line, it has taken the thread F to take up a V-shaped progression between the cone 25, the device 41, the V of the centraliser 46 and the mouth 44. In the lowest point of such a V-shaped path there is the preparer 50 of the thread F;
- the preparer group 50 of the end receives and takes the thread F from the centraliser 46, cuts it to size and prepares it for the actual reattachment operation.

After the delivery of the thread F to the preparer, both the mouth 44 and the centraliser 46 go back to rest. The configuration is now that of FIG. 4*b* is.

FIG. 5 shows the actual reattachment step:

- the group 50 delivers a tapered end of predetermined length to the introducer/remover 30;
- the introducer 30 then moves its pantograph 31 to move according to a working trajectory to go to the group 50 to take the thread F and then closes its gripping member 32 on the prepared end of thread F. It then moves from the preparing group 50, from an initial position shown with a full line to an end position shown with a broken line to go before the rotor 8, to introduce and re-extract the end of the thread in the opening 9 of the rotor 8.

According to a preferred embodiment of the present invention, the end of the device 30 is equipped with a centring element 35, having a conical end recess that engages in a conical pin 36 arranged on the front of the spinning unit, ensuring the precise positioning of the gripping member 32 with respect to the opening 9 of the spinning rotor during the final excursion of the pantograph 31.

During the final stages of the reattachment cycle, the thread F is now in centralised position and this easily fits into the sensor 15 of the thread that is under the mobile roller 12, during the steps of restarting normal spinning;

- The supply of the rove S to the rotor 8 begins to deposit a well-dosed amount of fibres in the throat of the rotor 8 for reattachment. For such a purpose, the actuation of the supply in the reattachment step is carried out with a telescopic rotating shaft 70 that is extended to engage and actuate the roller 5 for supplying the rove for the necessary time. Such a member is installed in the same introducing/removing group 30 of the end of thread being reattached.

To introduce the end, the motor 34 of the roller 32*a* is actuated, at a time precisely correlated with the start of the supply of fibres, to advance a determined length of end in the opening 9 adjusting the speed and duration of the advancing time;

- after a short and determined pause, the end of thread is withdrawn from the opening 9 after having picked up the thread and thus restarted spinning. For such a purpose, the motor 34 of the roller 32*a* is actuated in the opposite direction, to re-extract and withdraw the joined thread at a controlled speed according to an acceleration ramp that corresponds to that of the spinning rotor;
- Once the operating speed has been reached the removal of the thread is once again carried out by the pair of cylinders 11/12, whereas the cone 25 is again actuated with the auxiliary roller 42, taking it to the operating speed. The introducing/removing device 30 can now free the thread F, opening its rollers 32*a,b* with the pneumatic cylinder 33, and go back into rest position;
- To restart normal spinning, the new disengaged thread is once again hooked by the thread guide 21 whereas the lifting group 54 once again rests the cone 25 on its roller 29 and the auxiliary roller 42 is taken away. The trolley C has finished its job, can withdraw its members to rest and can be directed towards other units of the spinning machine.

According to a preferred embodiment of the present invention, during the step of introducing the end and of picking up the new thread, there is the highly advantageous effect that the thread and the end are always under control in every step of the intervention and cannot become entangled or give rise to knots, especially in actual reattachment. For such a purpose, during actual reattachment, the device 41 for controlling the thread is taken to a taut position T to go up further with a brief controlled stroke so that thread and end are always taut to avoid said drawbacks. This movement is strictly coordinated, in time and in stroke length, with the operation carried out by the device for introducing and withdrawing the end from the rotor 8 to pick up the new fibres from the throat of the rotor itself.

The same effect can, alternatively, be obtained by taking a suction mouth—for example the same mouth 44 for capturing the end from the side of the cone 25—to capture the possible curve of thread that is not taut downstream of the rotor 8; after the winding onto the cone has restarted regularly, it pulls back the length of thread sucked up that formed the curve from the inside of such a mouth.

The introducing/removing device 30 of the end of thread from the spinning rotor 8 allows its function to be carried out efficiently and flexibly in the intervention cycles of the service trolley of an open-end spinning machines and, moreover, has substantial progressions with respect to the devices of the prior art. Amongst these, at least the following deserve to be mentioned.

The device is able to carry out joins with different characteristics: it can be actuated in its sequence of rotations to introduce and remove the end to join the thread driven in frequency to obtain angular positions, speeds and accelerations that are controlled in every step of its operation in the two directions of rotation. This characteristic allows the operating parameters to be modified on each occasion: for example, operating in a lifting step with the auxiliary thread it is possible to adopt parameters for making a larger join. In it the mechanical resistance is enhanced, since the joined portion is then eliminated and has no influence upon the quality of the thread produced. On the other hand, in the reattachment cycle the aesthetic aspect of the thread is enhanced, adopting different operating parameters for it. Following a failed reattachment, the subsequent attempts can be driven with parameters that are modified by the trolley control unit.

In the same way, considering the fact that the open-end spinning machine is used in cycles to produce yarn with different characteristics, in terms of counts, number of twists per meter, production speed and so on, for each cycle it is possible to foresee a different driving of the device for introducing and moving the end of the thread from the rotor.

The device according to the invention also operates the moving of the end of the thread from/to the preparer 50 of the thread and cooperates with the other components of the servicing system for the spinning machine.

The auxiliary devices that keep the thread taut, but without substantial tension, during the actual reattachment step, substantially increase the certainty of the positive outcome of the join, especially in the production of so-called kinky yarn, i.e. that tends to curl.

What is claimed is:

1. Introducing/removing device of the end of the thread for an automatic service trolley for spinning units of open-end spinning machines for carrying out intervention cycles for starting, reattachment and lifting on the spinning units, said trolley carrying on-board members or groups of members dedicated to single or multiple operations of the various cycles, said introducing/removing device (30) comprising a moving structure (31), capable of taking a gripping member into various working positions to take, grip, pull, release and deliver the thread to the various members of the trolley and of the spinning machine, characterised in that its gripping member (32) consists of a pair of parallel rollers **(32*a*, 32*b*) pressed against each other according to their generatrices, and arranged with their axes substantially perpendicular to the direction of movement of the device (30) and can be moved apart from each other to take and release the thread, said rollers (32*a*, 32*b*) being equipped with an actuation motor (34) capable of making the rollers themselves rotate in commanded rotation in the two directions and controlled in angular position and speed, to introduce and re-extract the end of the thread in the opening (9) of the rotor (8)**.

2. Introducing/removing device of the end of the thread according to claim 1, characterised in that the moving structure (31) is a pantograph structure.

3. Introducing/removing device of the end of the thread according to claim 1, characterised in that of the two rollers **(32*a, b*) of the gripping member (32) one (32*a*) is motorised and the other (32*b*) is idle, and in that said rollers are kept pressed and closed against each other by a spring system, the actuation for causing them to open being carried out with a pneumatic cylinder (33)**.

4. Introducing/removing device of the end of the thread according to claim 1, characterised in that on the axis of the motorised cylinder **(32*a*) a brushless actuation motor (34)** is arranged that is driven in frequency to obtain angular positions, speeds and accelerations that are controlled in every step of its operation in both directions of rotation, according to the driving that is imparted by the trolley control unit.

5. Introducing/removing device of the end of the thread according to claim 1, characterised in that on the axis of the motorised cylinder **(32*a*) a stepper actuation motor (34)** is arranged that is driven in steps to obtain angular positions, speeds and accelerations that are controlled in every step of its operation in both directions of rotation, according to the driving that is imparted by the trolley control unit.

6. Introducing/removing device of the end of the thread according to claim 1, characterised in that a centring element (35) is placed in its end that engages in an abutment (36) on the front of the spinning unit, for the precision positioning of the gripping member (32) with respect to the spinning rotor.

7. Introducing/removing device of the end of the thread according to claim 1, characterised in that the actuation means of the device (30) for introducing and withdrawing the end from the rotor (8) to catch the new fibres from the throat of the rotor are coordinated, by the trolley control unit, with thread tautening devices so that during introduction and removal thread and end are always fully taut and cannot become entangled.

8. Introducing/removing device of the end of the thread according to claim 6, characterised in that the thread tautening device is the device (41) for controlling the thread taken into a taut position T to go up further with a brief controlled stroke that is strictly coordinated by the trolley control unit.

9. Introducing/removing device of the end of the thread according to claim 6, characterised in that the thread tautening device is a suction mouth that is actuated to capture the possible curve of the thread that is not taut downstream of the rotor (8).

* * * * *